US012624436B2

(12) United States Patent
Cetinkaya et al.

(10) Patent No.: US 12,624,436 B2
(45) Date of Patent: May 12, 2026

(54) METHOD FOR PRODUCING A HOT-DIP-COATED STEEL SHEET AND HOT-DIP-COATED STEEL SHEET

(71) Applicant: ThyssenKrupp Steel Europe AG, Duisburg (DE)

(72) Inventors: Burak William Cetinkaya, Dortmund (DE); Fabian Junge, Wesel (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 139 days.

(21) Appl. No.: 18/710,024

(22) PCT Filed: Nov. 10, 2022

(86) PCT No.: PCT/EP2022/081502
§ 371 (c)(1),
(2) Date: May 14, 2024

(87) PCT Pub. No.: WO2023/088783
PCT Pub. Date: May 25, 2023

(65) Prior Publication Data

US 2025/0011910 A1 Jan. 9, 2025

(30) Foreign Application Priority Data

Nov. 17, 2021 (DE) ..... 10 2021 129 934.9

(51) Int. Cl.

| | |
|---|---|
| ***C23C 2/06*** | (2006.01) |
| ***B21B 1/22*** | (2006.01) |
| ***C23C 2/26*** | (2006.01) |
| ***C23C 2/40*** | (2006.01) |

(52) U.S. Cl.
CPC ..... *C23C 2/06* (2013.01); *B21B 1/22* (2013.01); *C23C 2/26* (2013.01); *C23C 2/40* (2013.01); *B21B 2001/228* (2013.01)

(58) Field of Classification Search
CPC ..... B21B 1/22; B21B 2001/228; B21B 1/227; B21H 8/005; C23C 2/06; C23C 2/26; C23C 2/40; C23C 2/0062; C23C 2/02
See application file for complete search history.

(56) References Cited

U.S. PATENT DOCUMENTS

| | | | | |
|---|---|---|---|---|
| 5,789,066 | A | 8/1998 | De Mare et al. | |
| 2023/0201899 | A1 * | 6/2023 | Vogt | B32B 15/04 428/600 |

FOREIGN PATENT DOCUMENTS

| | | | | |
|---|---|---|---|---|
| DE | 102015200764 | A1 | 7/2015 | |
| DE | 102019214135 | A1 | 3/2021 | |
| DE | 102019214136 | A1 * | 3/2021 | C23C 28/025 |
| DE | 102019215051 | A1 | 4/2021 | |
| DE | 102020208561 | A1 | 1/2022 | |
| EP | 2006037 | B1 | 12/2008 | |

(Continued)

OTHER PUBLICATIONS

Drawn Metal Tube, What is Cold Rolling? https://drawnmetal.com/what-is-cold-rolling. (Year: 2023).*

(Continued)

*Primary Examiner* — Hai Y Zhang
(74) *Attorney, Agent, or Firm* — RMCK Law Group PLC

(57) ABSTRACT

This disclosure relates to a method of producing a hot-dip-coated steel sheet and to a hot-dip-coated steel sheet.

14 Claims, 1 Drawing Sheet

(56) References Cited

FOREIGN PATENT DOCUMENTS

EP 2892663 B1 7/2015

OTHER PUBLICATIONS

First German Office Action for DE Application No. 102021129934.9 mailed Jun. 30, 2022.
International Search Report and Written Opinion for International Application No. PCT/EP2022/081502 mailed Feb. 10, 2023.
Second German Office Action for DE Application No. 102021129934.9 mailed Jul. 7, 2022.

* cited by examiner

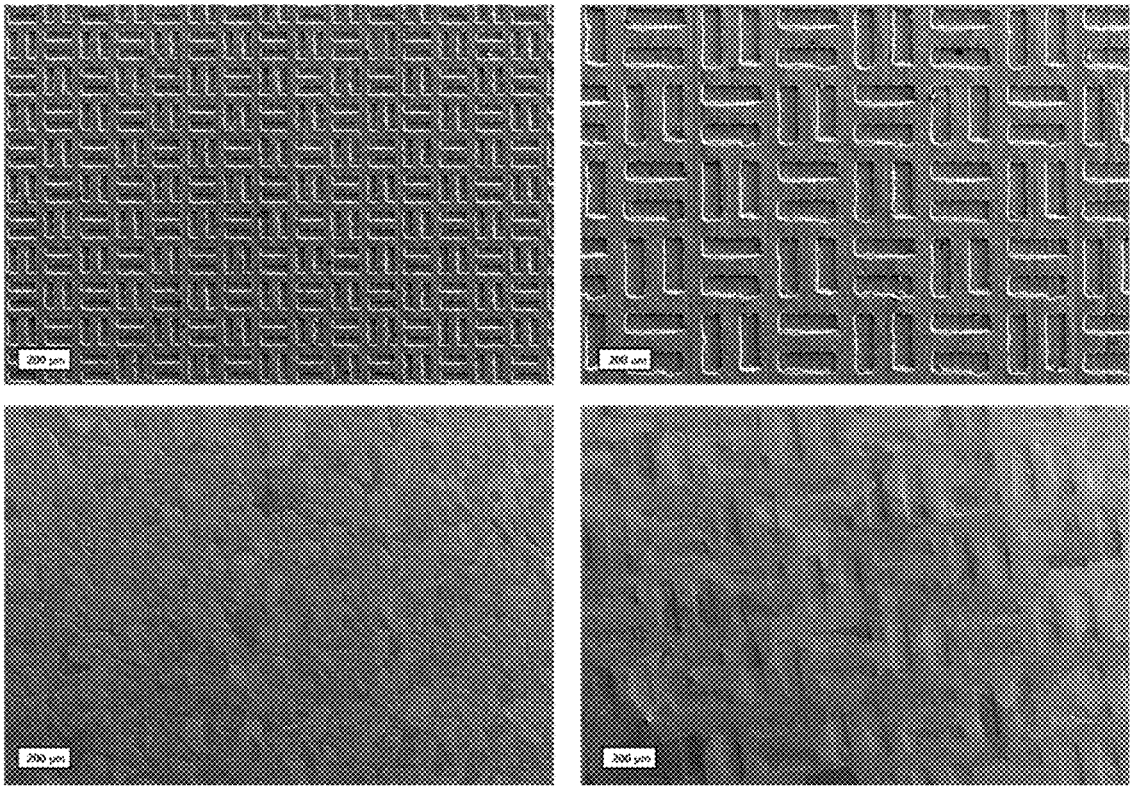
200 μm
200 μm
200 μm
200 μm

METHOD FOR PRODUCING A HOT-DIP-COATED STEEL SHEET AND HOT-DIP-COATED STEEL SHEET

CROSS-REFERENCE TO RELATED APPLICATIONS

This application is a 371 U.S. National Stage of International Application No. PCT/EP2022/081502 filed Nov. 10, 2022 which claims the benefit of German Patent Application No. 10 2021 129 934.9 filed Nov. 17, 2021. The disclosures of each of the above applications are incorporated herein by reference in their entirety.

The invention relates to a method of producing a hot-dip-coated steel sheet and to a hot-dip-coated steel sheet.

Ever more complex forming processes in the production of components in sheet design are leading to ever higher material stresses, and are in some cases accompanied by cracking within the coating of a hot-dip-coated sheet, especially steel sheet. This is manifested in particular in regions of acute radii and (steel) sheet component regions that undergo a high degree of forming in the processing operation. Examples of these include steel components for the vehicle industry, the shaping of which is characterized by locally high deforming stress, or sheets in the industrial sector, for example trapezoidal sheets.

Conventionally, hot-dip-coated steel sheets having a zinc-based coating are employed, so that cathodic corrosion protection can be ensured. Although cracks in the zinc-based coating do not necessarily disrupt cathodic corrosion protection, the risk of a corrosion attack nevertheless rises with the possibility of air humidity penetrating up to the steel material (substrate). In the case of the vehicle industry, the coated surface of the steel sheet is treated by conversion chemistry only after forming/shaping, for example by phosphation, such that areas of the steel material that have been exposed in the forming/shaping operation are also closed again.

However, the presence of cracks in the coating and/or at the surface of the coating can have the effect that these are filled by a process medium, for example an (alkaline) cleaner, an (alkaline) activation or an (acidic) phosphation and cannot be fully cleaned/dried. One effect of this can be that there is outgassing of these constituents (of the process medium) in the process of a heat treatment, for example in the baking operation in cathodic electrocoating. It is also additionally or alternatively conceivable for the constituents (of the process medium) that get stuck in the crack to remain, such that there can be formation of an alkaline or acidic solution within the cracks in the event of later contact with water, for example via diffusion through an applied paint layer, and these can attack the coating and hence adversely affect cathodic corrosion protection.

It is also possible for pretreatment or aftertreatment applied via what is called coil coating to locally break up the coating via cracks and cause it to locally lose its passivating action. For instance, in these applications, it is possible, for example, for the conversion layer to be undermined by moisture, which can lead to corrosion and in particular loss of paint adhesion.

It is thus known that cracking can damage the zinc-based coating so as to be able to result in loss of adhesion of the layer and/or at least of parts of the layer.

Crack propagation is promoted in the coating by the structure thereof. For instance, in the zinc-based coating which is applied in the liquid state to a steel substrate (steel sheet) in the hot dip operation and is then cooled and hence solidified, a small number of "large" zinc grains with the same orientation are formed, which extend throughout the coating thickness. When these crystals are stressed, there is the fracture in a preferential direction, depending on the orientation of the crystal. In the case of different crystal sizes, large crystals are less stable to mechanical stresses than small crystals. In order to be able to influence and hence vary the crystal sizes, it is either necessary to alter the process conditions, for example the cooling rate to bring about the solidification of the liquid coating, for example via accelerated cooling for achievement of small zinc flowers in the coating, or to enrich the zinc-based melt with additional elements, for example by addition of lead as nucleator. Changes to the process conditions in conventionally operated continuous strip galvanization processes are achievable only to a very limited degree: for example, cooling rates are technically limited or high cooling rates are possible at additional costs (high capital costs), and additions of further elements as grain refiners/nucleating agents can affect the coating system, which is complex in any case, not just economically, for example via the additional expenditure on the addition and the monitoring, but also in an adverse manner, for example via a negative influence on secondary metallurgy and the process regime, and also on the environment.

It is therefore the object of the invention to specify not only a method of producing a hot-dip-coated steel sheet but also a hot-dip-coated steel sheet with which the disadvantages from the prior art can be remedied.

The object in relation to the method of producing a hot-dip-coated steel sheet is achieved by the features of claim 1. The object in relation to the hot-dip-coated steel sheet is achieved by the features of claim 8.

A first teaching of the invention relates to a method of producing a hot-dip-coated steel sheet, by providing an in particular cold-rolled steel substrate, which is coated on one or both sides with a zinc-based coating by hot dip coating, in order to obtain a hot-dip-coated steel sheet, wherein the steel substrate provided, prior to the hot dip coating, has a deterministic surface structure on one or both sides.

Without having to implement the already known measures, some of which are complex, of influencing the zinc flower size via cooling rate and addition of grain refiners/nucleating agents, the inventors have found that the crystallization characteristics of zinc-based hot dip coatings can also be controlled in a targeted manner by simple means. The targeted control is imparted in accordance with the invention via a deterministic texture to the surface of the steel substrate on one or both sides prior to the hot dip coating. A deterministic surface texture is understood to mean repeating textures having a defined shape and/or configuration: cf., by way of example, EP 2 892 663 B1. The surface texture thus preferably has defined embossments and/or elevations, viewed for example in the cross section of the steel substrate, on the surface of the steel substrate. EP 2 892 663 B1 states that cold-rolled steel substrates having a deterministic texture are subjected to skin pass rolling, and then a cathodic anticorrosion coating is electrolytically deposited. Electrolytic deposition is not comparable to a hot dip coating process.

Especially by virtue of the freedom of shape and the deterministic distribution of the texture on the surface of the steel substrate, it is thus surprisingly possible to influence the distribution and/or size of the crystallization nuclei of the zinc grains in the zinc-based coating. The crystallization nuclei of the zinc grains form at the interface between liquid zinc-based melt and steel substrate, such that there is lateral growth of the crystals in the coating in the course of solidification until they meet in each case (their) neighboring crystals. By virtue of the present deterministic surface texture, the shape and/or dimension of the texture thus preferably provide defined zones in the form of embossments and/or elevations, where crystallization is initialized and promoted, such that, depending on the form of deterministic texture, a preferably high density of crystallization nuclei can grow until they meet (their) neighbors. With regard to cracking characteristics, cracks within a crystal always run parallel to one another, as shown by studies. Thus, cracks can propagate without disruption within the crystal and are only stopped when they reach the grain boundary, and the adjoining differently oriented crystals. Accordingly, cracks can propagate more quickly and broadly within a few large crystals than in many small crystals. A high density of crystallization nuclei leads to small crystals, such that a finely crystalline coating is more resistant to the macroscopic formation of cracks.

The deterministic texture can act on one or both sides in the case of a steel substrate of the surface of the steel substrate either in the course of a cold rolling process or in a separate rolling process by means of correspondingly deterministically structured rolls. The deterministic texture is preferably imparted to the surface of the steel substrate in the course of a cold rolling process, where the last roll stand of a cold rolling train is equipped with at least one roll, preferably with a roll pair, having a corresponding deterministic structure. Methods and apparatuses for production of roll structuring are prior art: cf. EP 2 892 663 B1 inter alia. A laser is preferably used to introduce a deterministic topography into the surface of the roll by material removal.

A steel substrate is understood to mean a flat steel product that may take the form of a strip, blank or sheet. Preference is given to using a cold-rolled steel substrate. The production of cold-rolled steel substrates is likewise prior art.

The hot dip coating of a steel substrate with a zinc-based coating is also prior art.

In one configuration, the deterministic surface texture has a closed texture with embossments. What is meant by a closed texture on the surface of the steel substrate is that individual embossments are provided, which go into the depth of the substrate, but are essentially not (all) connected to one another and hence are considered to be closed. This means that there also exists essentially only one continuous elevation, oriented essentially in the plane at the surface of the steel substrate.

In an alternative configuration, the deterministic surface texture has an open texture with elevations. What is meant by an open texture on the surface of the steel substrate is that individual elevations are provided, which protrude from the plane of the substrate, but are essentially not (all) connected to one another and hence are considered to be open. This means that there also exists essentially only one continuous embossment, oriented essentially in the plane in the lowermost region of the elevations of the steel substrate.

In one configuration, the deterministic surface texture has at least one embossment or at least one elevation that occupies an area between 100 and 25 000 $\mu m^2$. The area may especially be at least 200 $\mu m^2$, preferably at least 400 $\mu m^2$, and especially at most 20 000 $\mu m^2$, preferably at most 18 000 $\mu m^2$. There are preferably two or more embossments or two or more elevations, each of which has an area having in each case a centroid, where the distance between at least two adjacent centroids is between 10 and 1000 μm. The smaller the areas and the smaller the distances between the respective centroids, the higher the number of crystallization nuclei that form at the interface between liquid zinc-based melt and steel substrate.

In one configuration, the zinc-based coating, as well as zinc and unavoidable impurities, contains additional elements such as aluminum with a content of up to 10.0% by weight and/or magnesium with a content of up to 10.0% by weight in the coating. Impurities present in the coating may be elements from the group of Si, Sb, Pb, Ti, Ca, Mn, Sn, La, Ce and Cr, individually or in combination with a total of up to 0.5% by weight. If improved corrosion protection is envisaged, the coating additionally contains magnesium with a content of at least 0.3% by weight, especially of at least 0.6% by weight, preferably of at least 0.9% by weight. Aluminum may be present alternatively or additionally to magnesium with a content of at least 0.1% by weight, especially of at least 0.3% by weight, in order, for example, to improve binding of the coating to the steel substrate and especially to essentially prevent diffusion of iron from the steel sheet into the coating in the course of heat treatment of the coated steel sheet, in order that it is possible, for example, to assure good suitability for bonding. The coating preferably includes magnesium with a content of at least 1.0% by weight and aluminum with a content of at least 1.0% by weight. If magnesium and aluminum are present in the coating, this is referred to hereinafter as a Zn—Al—Mg coating. Aluminum or magnesium may each be present in the coating in particular up to a maximum of 8.0% by weight, preferably up to a maximum of 6.0% by weight, more preferably up to a maximum of 5.0% by weight. This coating may have a thickness between 1.5 and 15 μm, especially between 2 and 12 μm, preferably between 3 and 10 μm.

In one configuration, the hot-dip-coated steel sheet is subjected to skin pass rolling in order to impart a desired surface texture to the coating and/or to establish the final mechanical properties in the steel sheet. The skin pass rolling can be conducted with a deterministically structured skin pass roll, cf. by way of example EP 2 892 663 B1, or alternatively with a stochastically structured skin pass roll, cf., for example, EP 2 006 037 B1.

The steel substrate may consist of a steel material having the following chemical composition in % by weight:

C up to 0.1%, especially between 0.0002% and 0.1%,
Mn up to 2.0%, especially between 0.01% and 2.0%,
Si up to 0.3%, especially between 0.0002% and 0.3%,
P up to 0.1%, especially up to 0.05%,
S up to 0.1%, especially up to 0.05%,
N up to 0.1%, especially up to 0.01%,
and optionally one or more alloy elements from the group of (Al, Cr, Cu, Nb, Mo, Ti, V, Ni, B, Sn, Ca):
Al up to 0.2%, especially between 0.001% and 0.1%,
Cr up to 1.0%, especially up to 0.8%,
Cu up to 0.2%, especially up to 0.18%,
Nb up to 0.1%, especially up to 0.05%,
Mo up to 0.2%, especially up to 0.1%,
Ti up to 0.2%, especially up to 0.15%,
V up to 0.2%, especially up to 0.1%,
Ni up to 0.2%, especially up to 0.18%,
B up to 0.005%, especially up to 0.004%,
Sn up to 0.1%, especially up to 0.05%,
Ca up to 0.1%, especially up to 0.01%,
balance: Fe and unavoidable impurities.

In a second teaching, the invention relates to a hot-dip-coated steel sheet comprising a steel substrate with a zinc-based coating applied to one or both sides, where the steel substrate has a deterministic surface texture on one or both sides.

A higher density of the zinc grains in the coating is generally accompanied by a smaller, finer grain size, such that the grain boundaries in an area in question can also be increased, these having higher reactivity by comparison with lower density and hence small grain boundaries in the area in question with downstream pretreatments or aftertreatments of the hot-dip-coated steel sheet. Thus, the zinc grain sizes are between 20 and 250 μm, especially up to a maximum of 220 μm, preferably up to a maximum of 170 μm, more preferably up to a maximum of 130 μm, further preferably up to a maximum of 105 μm. The size of a zinc grain is defined, for example, by a scanning electron micrograph, as the greatest possible difference between two points within a coherent grain having the same orientation.

In order to avoid repetitions, reference is made to the advantageous configurations of the method of the invention.

The sole FIG. 1 shows scanning electron micrographs (SEM) of two surface-textured steel substrates before and after hot dip coating with a zinc-based coating in top view. The deterministic surface texture imparted was embossments into the surface of the steel substrate, for example in the form of a double-I texture in accordance with EP 2 892 663 B1. The deterministic surface texture was thus in both cases a closed texture. The texture differed merely in the dimensioning of the embossed I texture: in the image top left with 80 μm×25 μm and hence an area of 2000 $\mu m^2$ per embossed "I", and in the image top right with 210 μm×70 μm and hence an area of 14 700 $\mu m^2$ per embossed "I" in FIG. 1. In the case of the embossed "I"s, it is easily possible in each case to ascertain the centroid for each area, where the distance between at least two adjacent centroids for the left-hand image was 50-70 μm, for example, and for the right-hand image 120-150 μm, for example. The grain sizes in the left-hand image are up to a maximum of 200 μm and in the right-hand image up to a maximum of 900 μm. Using the example for different configurations or dimensions of the deterministic surface texture of a steel substrate, the lower left-hand image by comparison with the lower right-hand image in FIG. 1 illustrates that finer textures (top left) on the surface of the steel substrate give rise to smaller zinc grains (bottom left). The crystallization seeds form preferentially at the transitions where the embossments adjoin the surface of the steel substrate.

The density of the crystallization seeds is accordingly dependent on the dimension of the texture or on the number of textures per unit area. In all tests, it was found that those steel substrates with a higher number of structures based on a constant area always had smaller zinc grains after hot dip coating. Comparable results (not shown here) were also found in the case of Zn—Al—Mg coatings. In the case of assessment of hot-dip-coated coatings with eutectic phases (Zn—Al—Mg coating), a finer grain structure at the surface of the steel substrate is advantageous for corrosion resistance. Based on the Zn—Al—Mg coating, $MgZn_2$ in the eutectic phase is a sacrificial anode for the zinc grains. This means that, under corrosive stress on the coating, there is firstly attack on the $MgZn_2$ phases, for example in the case of acidic pretreatments or aftertreatments of the hot-dip-coated steel sheets (pickling), or on the Al phases, for example in the case of alkaline pretreatments or aftertreatments of the hot-dip-coated steel sheets (degreasing and/or cleaning, especially prior to pickling), in the eutectic and subsequently on the zinc grains. Under air, such a protective effect (anodic sacrificial mechanism) is essentially dependent on the distance between the less base and more base metallic phase. If the phases are spatially too far removed from one another, cathodic corrosion protection can no longer be assured. Accordingly, smaller zinc grains surrounded by eutectic are advantageous for corrosion resistance since the distance of eutectic from the middle of the zinc grain is smaller and hence anodic sacrifice of the phases in the eutectic for protection of the zinc can be better enabled.

The invention claimed is:

1. A method of producing a hot-dip-coated steel sheet, the method comprising:

providing a cold-rolled steel substrate, having a deterministic surface structure on one or both sides;

subsequent to the providing, coating on the cold-rolled steel substrate having a deterministic surface structure on one or both sides with a zinc-based coating by hot dip coating, in order to obtain the hot-dip-coated steel sheet, wherein the deterministic surface structure is applied to the steel substrate prior to the hot dip coating to influence a crystallization nuclei density of the zinc-based coating during solidification; and subjecting the hot-dip-coated steel sheet to skin pass rolling.

2. The method as claimed in claim 1, wherein the deterministic surface texture has a closed texture with embossments.

3. The method as claimed in claim 2, wherein the closed texture comprises two or more embossments each occupying an area between 100 and 25,000 $\mu m^2$ and each having a centroid, wherein the distance between at least two adjacent centroids is between 10 and 1,000 μm.

4. The method as claimed in claim 1, wherein the deterministic surface texture has an open texture with elevations.

5. The method as claimed in claim 4, wherein the open texture comprises two or more elevations each occupying an area between 100 and 25,000 $\mu m^2$ and each having a centroid, wherein the distance between at least two adjacent centroids is between 10 and 1,000 μm.

6. The method as claimed in claim 1, wherein the deterministic surface texture has at least one embossment or at least one elevation that occupies an area between 100 and 25 000 $\mu m^2$.

7. The method as claimed in claim 6, wherein two or more embossments or two or more elevations are present, each of which has an area each with a centroid, where the distance between at least two adjacent centroids is between 10 and 1000 μm.

8. The method as claimed in claim 1, wherein the zinc-based coating, in addition to zinc and unavoidable impurities, contains additional elements such as aluminum with a content of up to 10.0% by weight and/or magnesium with a content of up to 10.0% by weight in the coating.

9. The method as claimed in claim 1, wherein the deterministic surface structure on the cold-rolled steel substrate provides nucleation sites at an interface between a liquid zinc-based melt and the cold-rolled steel substrate during the hot dip coating, thereby controlling a distribution and density of crystallization nuclei of zinc grains in the zinc-based coating upon solidification.

10. The method of claim 1, wherein the deterministic surface structure on the cold-rolled steel substrate increases a density of crystallization nuclei of zinc grains at the interface between the liquid zinc-based melt and the cold-rolled steel substrate relative to a cold-rolled steel substrate lacking the deterministic surface structure, resulting in a finer-grained zinc-based coating.

11. The method of claim 1, wherein the deterministic surface structure is imparted to the one or both sides of the cold-rolled steel substrate in the course of a cold rolling process, wherein at least one roll of a last roll stand of a cold rolling train is provided with a corresponding deterministic structure.

12. The method of claim 11, wherein the deterministic structure on the at least one roll is introduced by laser material removal.

13. The method as claimed in claim 1, wherein the deterministic surface structure is imparted to the one or both sides of the cold-rolled steel substrate in a separate rolling process conducted after cold rolling and before the hot dip coating, by means of at least one roll having a corresponding deterministic structure.

14. The method as claimed in claim 1, wherein the cold-rolled steel substrate has a chemical composition comprising, in percent by weight: C up to 0.1%; Mn up to 2.0%; Si up to 0.3%; P up to 0.1%; S up to 0.1%; N up to 0.1%; and balance iron and unavoidable impurities.

* * * * *